United States Patent [19]

Homocky et al.

[11] 4,366,681

[45] Jan. 4, 1983

[54] DETECTION OF FLAWS, BREAKAGES, DISCONTINUITIES AND THE LIKE

[75] Inventors: John Homocky, Cheshire; Joseph Venczel, Manchester, both of England

[73] Assignee: Meiners Electronic Controls Ltd., London, England

[21] Appl. No.: 42,541

[22] Filed: May 25, 1979

[30] Foreign Application Priority Data

May 31, 1978 [GB] United Kingdom ..... 25099/78

[51] Int. Cl.[3] ..... D04B 35/10

[52] U.S. Cl. ..... 66/165; 66/157

[58] Field of Search ..... 66/157, 165, 163, 166, 66/162

[56] References Cited

U.S. PATENT DOCUMENTS

| | | | |
|---|---|---|---|
| 3,690,127 | 9/1972 | Tellerman et al. | 66/157 |
| 3,906,752 | 9/1975 | Eichorst | 66/157 |
| 3,946,578 | 3/1976 | Venczel | 66/157 |
| 4,026,128 | 5/1977 | Blanco | 66/165 |
| 4,027,982 | 6/1977 | Ohishi | 66/157 |

*Primary Examiner*—Ronald Feldbaum
*Attorney, Agent, or Firm*—Howard L. Rose

[57] ABSTRACT

A detector device is provided, in particular for detecting faulty needles or closed needle latches in a knitting machine with latch type needles, consisting of a non-electrically-conductive feeler which is normally resiliently urged into contact with the upper parts of the needle hooks, and an electrically-conductive probe which normally does not contact the needles but passes through the needle hook openings as relative movement of the needles past the detector takes place. However, if a needle latch is closed the probe makes contact with it and also if the needle hook is broken or bent the feeler is permitted to move laterally thereby enabling the probe to contact the faulty needle, contact of the probe with a needle completing an electrical circuit which signals a needle fault. For circular knitting machines in which the needles travel past the detector, the detector is associated with a controller that stops the machine when the faulty needle reaches a particular position in the needle travel path. By presetting two numbers into count circuits in the counter and stopping the machine first at the lower number before the final stopping position is reached and then allowing the machine to crawl to the final stopping position represented by the higher count numbers, errors in final stopping position due to machine overrun are largely or wholly eliminated. In a flat bed machine with stationary needles the detector may be mounted on a mobile carrier to traverse the needle bed and be associated with a battery-powered ultrasonic transmitter for transmitting the fault signal to a stationary receiver on the machine frame.

26 Claims, 20 Drawing Figures

DETECTION OF FLAWS, BREAKAGES, DISCONTINUITIES AND THE LIKE

This invention relates to the sensing of surfaces, or of beds or arrays of items or components, for the detection of flaws, breakages, discontinuities and the like. More specifically, it is concerned with instances in which it is required to monitor a surface or a bed or array of items for several different kinds of breakage or discontinuity simultaneously.

A particular field in which the invention is useful is in relation to latch-type needles in knitting machines. There is a requirement to detect any needles that have closed latches when the latches should open; and also to detect needles with snapped-off hooks. It may additionally be required to detect bent needles and needles broken off at the shank. Hitherto, there has been a lack of any means of performing these functions simultaneously and it is an object of the invention to remedy this lack.

According to the present invention, a detector device is provided which has a feeler element normally urged resiliently into contact with the surface, bed or array to be monitored as the detector and said surface, bed or array move relatively past one another, and a probe element that is normally out of contact with said surface, bed or array, the arrangement being such that one type of flaw, fault or the like can be sensed by said probe element contacting said surface, bed or array without lateral movement of the detector while another type of flaw, fault of the like is sensed as a result of said feeler element in contact with the surface, bed or array moving laterally toward the plane of said surface, bed or array and carrying the probe element into contact with it.

Figure 1:
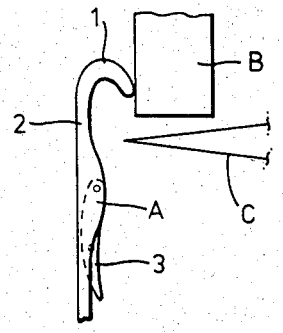
Figure 2:
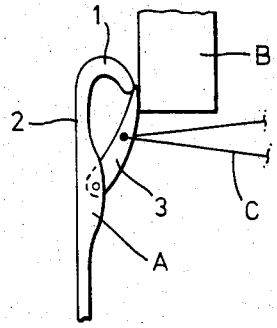
Figure 3:
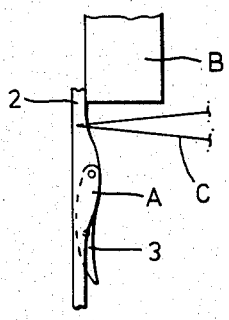
Figure 4:
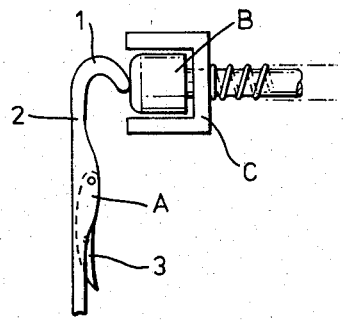
Figure 5:
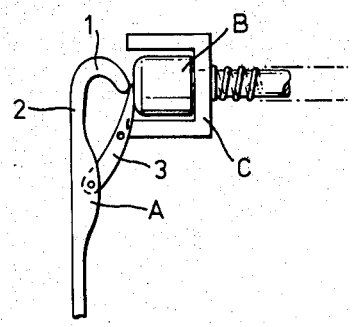
Figure 6:
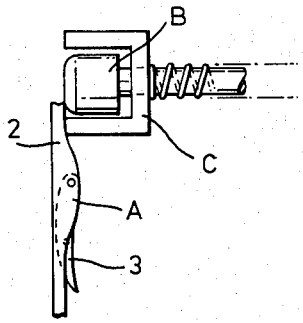
Figure 17:
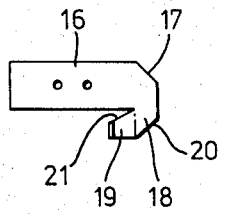
Figure 18:
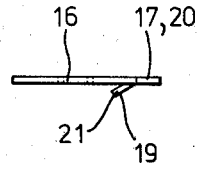
Figure 20:
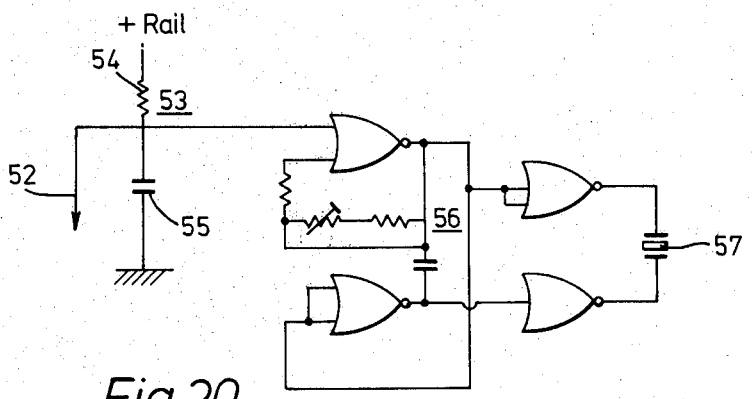
Figure 19:
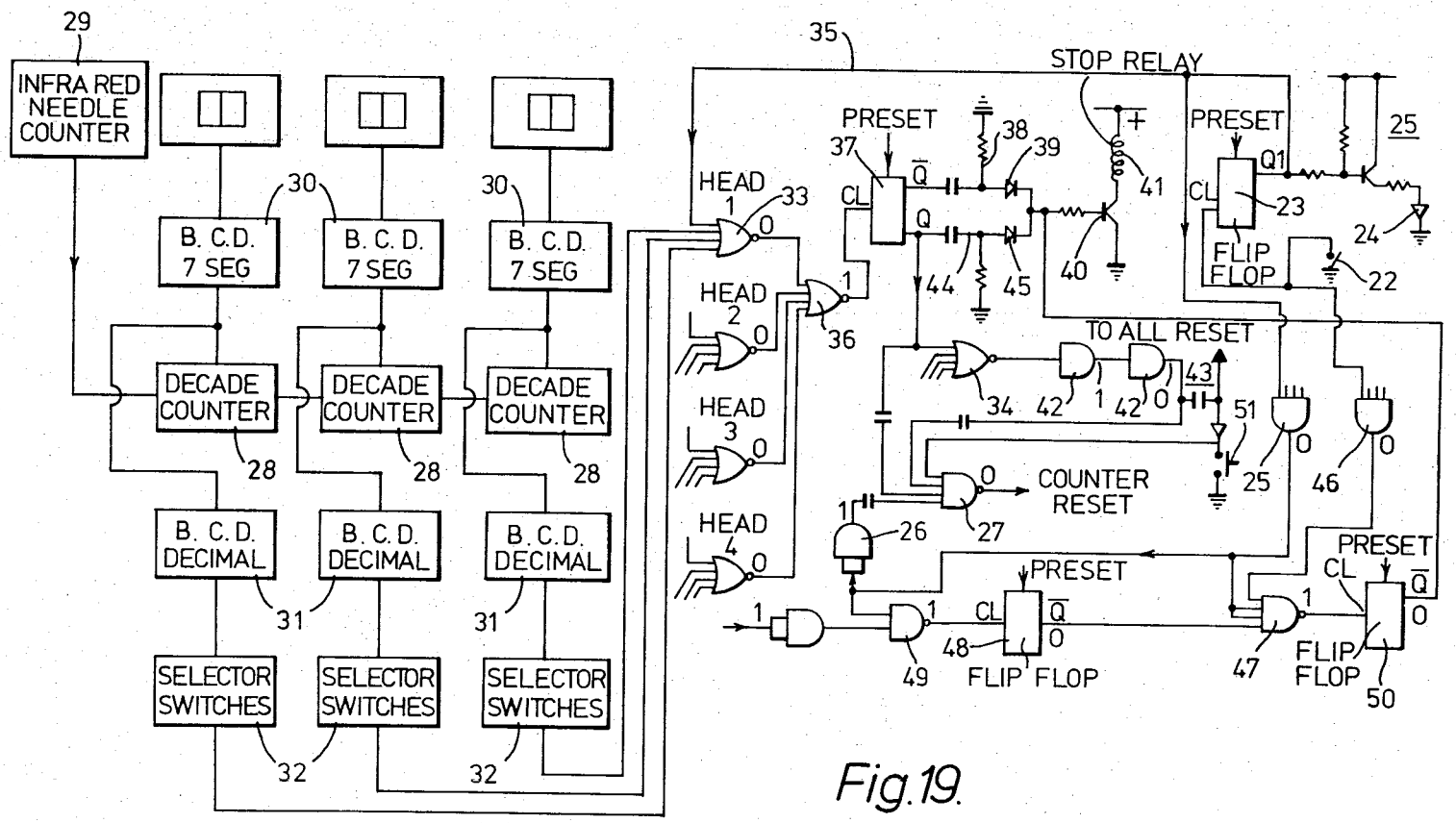

Various ways of carrying the invention into effect will now be described by way of example, with reference to the accompanying drawings, in which:

FIG. 1 is a diagram of one form of needle fault detector for knitting machines with latch type needles, FIGS. 2 and 3 illustrate two possible fault conditions in the case of the detector of FIG. 1, FIG. 4 is a diagram of another form of needle fault detector, FIGS. 5 and 6 illustrate two possible fault conditions in the case of the detector of FIG. 4, FIGS. 7, 8 and 9 are, respectively, a diagrammatic front elevation, plan and end elevation of another form of fault detector, FIGS. 10 to 13 illustrate four possible fault conditions in the case of the detector of FIGS. 7 to 9, FIGS. 14, 15 and 16 are, respectively, a front elevation, plan and end elevation of the feeler element of a practical embodiment of fault detector, FIGS. 17 and 18 are, respectively, a front elevation and plan of the probe element for the same fault detector, FIG. 19 is a circuit and block diagram of a controller for processing the signals from the fault detector and energising a machine stop motion, and FIG. 20 is a circuit diagram of a battery-operated transmitter for a mobile fault detector for flat bed knitting machines.

In FIG. 1 of the drawings, latch-type needles A of a circular knitting machine run past a detector comprising a non-electrically-conductive feeler roller B, resiliently urged into engagement with the tops 1 of the needle hooks 2 on the latch side, and an electrically-conductive probe C under the roller B, preferably spring-mounted, and directed toward the openings of the needle hooks 2 but out of contact with the needles when the latches 3 of the needles are open.

As seen in FIG. 2, should a needle latch 3 be closed, the probe C will make contact with it. If, on the other hand, a needle hook has been snapped off. FIG. 3 shows that the detector roller B will shift laterally, to the left in the drawings, due to the absence of the hook, and carry the probe C into contact with the needle. In either case, the contact between the probe C and the needle can be employed to operate a relay initiating an alarm, and/or actuating a stop motion.

In FIGS. 4 to 6, the detector roller is replaced by a spring-urged plunger B, rounded for smooth passage against the needle hooks, and the function of the probe is performed by a U-shaped member C having arms embracing and projecting beyond the plunger. The manner of operation is generally as before.

Other arrangements are possible without departing from the scope of the invention. Thus the detector element B could engage the backs of the needle hooks and be mechanically or otherwise coupled to the probe C in such manner that as the detector element B moves in toward the needle bed from one side the probe C also moves in from the other side.

A simple embodiment utilises a generally S-shaped spring strip as the detector, the upper bend of the S constituting the feeler element B and the bottom termination of the S the probe C. If the S-strip is appropriately fixed on a carrier at its upper termination, the springiness in the strip itself can provide the necessary resilience for the operation of the device. The spring strip can be of electrically-conducting metal, with its upper bend coated with a material such as a low-friction wear-resistant plastics material, to make its contact surface non-conductive. For easy riding over the needles, the side margins of the S-strip are preferably chamfered or bevelled away from the needle bank.

Figure 7:
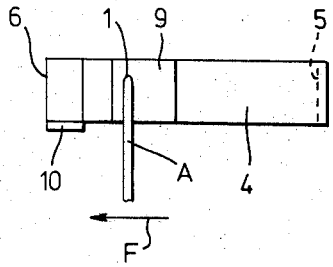
Figure 8:
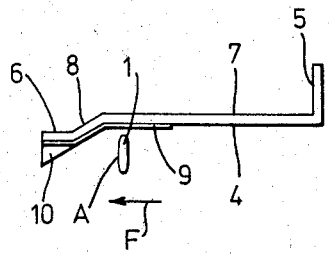
Figure 13:
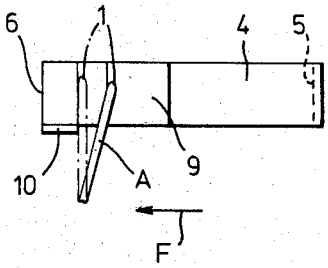
Figure 9:
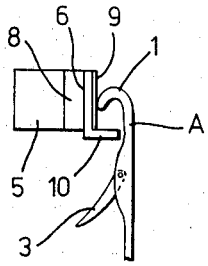

FIGS. 7 to 9 show another form of detector consisting of bent springy metal strip material. The strip 4 is of long rectangular shape and has a portion 5 bent through a right angle at one end which serves for mounting the detector. Near its opposite end, the strip 4 is cranked so that its end portion 6 is parallel to but offset with respect to the main portion 7, being joined to the main portion by an oblique section 8. The needles 9 travel past the detector in the direction parallel to the strip 4, indicated by the arrow F, and the offset end portion 6 is nearer to the path of the needles than the main portion 7 so that the oblique section 8 and the end portion 6 engage the top of the hook 1 of each needle, as seen in FIG. 9, assuming the needle is not damaged in any way and the latch 3 is open. The strip 4 itself is electrically conductive but the surfaces that engage the top of the needle are faced with an insulating low-friction material 9.

Figure 10:
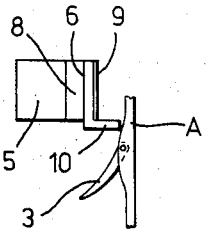
Figure 11:
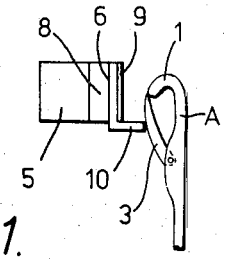
Figure 12:
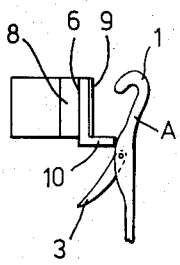
Figure 14:
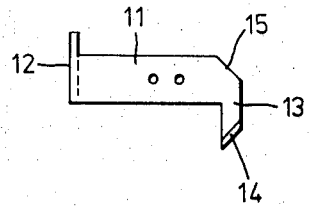
Figure 15:
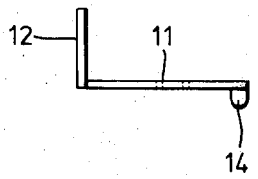
Figure 16:
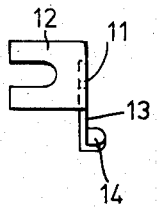

At the bottom of the offset end portion 6 of the detector there is a probe portion 10 in the form of a triangular flange bent at right angles to the end portion 6 so that it projects into the hook openings of the needles as they pass. This probe has no insulating facing material so that if it should touch any part of a needle an electrical circuit is established. In the normal condition, when the needle is undamaged and the needle latch is open, the probe 10 is unable to contact the needle due to the engagement between the detector portion 6 and the needle hook, as seen in FIG. 9. However, if the hook is broken off the probe 10 makes electrical contact with the needle as shown in FIG. 10. Also, if the needle latch is closed, instead of open as it should be, the probe 10 will contact the latch 3 as shown in FIG. 11. Another fault situation that may occur is the bending back of the top of the needle hook to form a "swan neck" as shown in FIG. 12. In such a case the probe 10 contacts the needle because there is no contact between the top of the hook and the detector portion 6. Also, if the needle is faulty because it is bent laterally, as in FIG. 13, the engagement between the needle hook and the detector portion 6 and the passage of the tip of the probe 10 past the needle occur at different times during the travel of the needle and so the probe again makes contact with the needle.

Thus the same detector is able to signal the presence of broken hooks, bent needles and closed latches.

FIGS. 14 to 18 show, in various views, the two parts of a further form of detector. An electrically-insulating strip 11 has at one end a slotted securing bracket 12 bent at right angles to the strip, for mounting the detector, and at the other end a depending leg 13 with a small rounded lug 14 at its foot that projects at right angles to the leg but lies in a plane at 45° to the horizontal. The end corner 15 of the strip 11 above the leg 13 is also cut off at 45°, the 45° angle of this corner and that of the small lug 14 being of opposite slope. An electrically-conductive second strip 16, shorter than the strip 11, has its top end corner 17 cut off at 45° in similar fashion to the strip 11. It is secured behind the strip 11 in contiguity with it and with the 45° corners in matching alignment; the securing may be by riveting, adhesive or any other appropriate means. The strip 16 has a depending leg 18, like the leg 13 of the strip 11, the lower end 20 of which is cut off at 45° but which has no lug like the lug 14 of leg 13. Instead, the leg 18 has a side flange 19 which lies in a vertical plane that makes an obtuse angle with the plane of the leg and constitutes the probe of the detector, this flange extending past the leg 13 of the strip 11 so as to project at the side of the strip 11 opposite to that to which the strip 16 is secured. The top 21 of the flange 19 is cut off at 45° parallel to the lower end 20 of the leg 18.

It has been discovered that the same detector, appropriately adjusted, will operate satisfactorily with different sizes of needle on different machines, but it is necessary to provide both left-handed and right-handed detectors. The springiness of the detector must be such that the needle-engaging portion flexes closely in phase with the passage of the successive needles and does not bounce. It is convenient to place the detector at a situation where the needles are being cammed to cause vertical movement as well as the horizontal travel past the detector; the 45° angles of the detector of FIGS. 14 to 18 permit this, since at such a situation the needles are approaching the detector along a path at roughly that angle.

It is normally the intention that the detection of a faulty needle or closed latch shall send a signal to a machine knock-off control to stop the knitting machine. However, it is not desirable that the machine shall stop with the affected needle at some arbitrary position because that may make it difficult for the machine operator both to find it and to remedy the fault. It is much to be preferred that the needle which is affected shall always come to a stop within the same predetermined short portion of the total path of travel of the needles where the operator can see it easily and where there is ready access to the needles. Nevertheless, it has been discovered that stopping the machine from full speed when the faulty needle reaches a particular position is extremely difficult because of the overrun that occurs before the machine actually comes to rest, this overrun varying significantly in amount due to certain factors. For instance, a machine runs more freely when it is warmed up and so the amount of overrun will be greater when a machine has been running for a long time than when it has recently been restarted from cold. The problem can be solved by providing a control which first stops the machine shortly before the faulty needle reaches the desired stopping place, without regard to the precise position of the faulty needle, and then allows the machine to be 'inched' or crawled to bring the faulty needle to the final stopping place which is automatically determined within close limits. Such a control is shown in FIG. 19.

The controller of FIG. 19 has four channels to accommodate four detectors and each detector is capable of dealing with one or more faulty needles occurring at the same time. Provision for more than one detector is necessary because many knitting machines have more than one bank of needles. Each detector 22, upon detecting a faulty needle, provides a signal that triggers a respective input flip-flop 23. The flip-flop output immediately lights a channel indicator lamp 24 via a transistor circuit 25. The output of flip-flop 23 is also applied via an AND gate 25 and an inverter 26 to an input of an AND gate 27 the output of which resets decade counter stages 28 to zero. During normal running of the knitting machine the counter stages 28 continually and repeatedly count from zero up to a maximum number in response to the input pulses from an infra red needle sensor 29 which delivers a signal pulse at the passage past it of every needle.

The counter stages 28 are associated with B.C.D. registers 30, 31. The counter stages are connected, via respective registers 31 and selector switches 32, to a first count gate 33 and to a second count gate 34. The counter-register combination is preset with two numbers appertaining to the two count gates 33, 34. One number is equal to the number of needles between the position of the fault detector and the position at which it is desired that a faulty needle shall stop for attention by the operator. The other preset number is a smaller number. After the counter stages have been reset to zero by the signal from the gate 27, continued running of the knitting machine causes the counter stages to count up from zero until the aforesaid smaller preset number is reached. At this point the first count gate 33, which has already been enabled by the output from the flip-flop 23 on line 35, delivers an output which is applied via AND gate 36 to trigger a flip-flop 37. The Q output of flip-flop 37 goes high and a pulse is applied via RC circuit 38 and diode 39 to the driver transistor 40 of stop motion relay 41. The machine consequently stops. The Q output of flip-flop 37 goes low, which enables gate 34 and also again resets the counter stages to zero via gate 27.

The machine operator may now restart the machine, using the "crawl" control of the machine if there is one. The count recommences and the machine runs until the total count accumulated since the detector first detected the faulty needle is equal to the aforesaid larger preset number. At this point the second count gate 34, which has been enabled by the Q output of the flip-flop 37, delivers an output via inverters 42 to a reset signal output circuit 43. The reset signal resets the counters and the flip-flops 23 and 37. When the flip-flop 37 is reset its Q output goes high and a positive pulse is delivered via RC circuit 44 and diode 45 to the driver transistor 40 of the stop motion relay 41. Therefore, the knitting machine again stops.

When the knitting machine stops for the first time at the lower preset count number there will be considerable overshoot of that number because the machine is stopping from high speed. However at the second stop the overshoot, if any, will be very small because the machine is stopping from a crawl speed, and the faulty needle will be brought to rest at no more than a very few needle places removed from the predetermined final position represented by the larger preset count number. The large overshoot at the first stop is of no consequence providing that the lower preset count number is sufficiently less than the higher preset number to ensure that even the largest overshoot that can occur in operation will not carry the faulty needle as far as the final position represented by the higher number. The overshoot will simply be automatically deducted from the amount of further travel the needles must make during the final crawl stage. However, it is desirable that the final crawl movement should be small; and in the case of a machine not having a crawl capability the final movement must be small in order to prevent the machine picking up speed before the final stopping position is reached. After the final stop, the controller may display a small residual number which represents the number of needle places between the desired or chosen stopping position and the position at which the faulty needle has actually stopped. This makes it a very easy matter for the machine operator to find the faulty needle.

Each signal from the fault detector 22 appears via a gate 46 at the input of a gate 47, which gate also receives the output of a flip-flop 48 and, via gate 25, the output of the flip-flop 23. The flip-flop 48 is triggered by the output of a gate 49 which receives on its input the output of the gate 25 and such signal as may arise due to detection of a faulty needle by a second detector. The output of the gate 47 triggers a flip-flop 50 the output of which is applied directly to the driver circuit of the stop motion relay 41. This arrangement constitutes a lock-out facility that causes the machine to stop immediately if a second needle fault occurs before the first one has been cleared. A warning light is lit and remains lit until all faults have been dealt with. A manual rest button 51 is provided for resetting the circuits in this case. In such way, the operator is made aware that he must not restart the machine, after remedying one fault, if another fault still exists. This avoids the occurrence of a press-off, i.e. dropping of the fabric being knitted off the needles due to the machine being run with a fault, which is of great importance because, after a press-off, it takes a considerable time for the operator to return the fabric to the needles and restart the machine.

In the above description, it has been assumed that the detector is stationary and the needles are moving past it, as will be the case in circular knitting machines. However, the invention is also applicable to straight flat bed knitting machines in which the needles do not travel. If the needles do not travel then the detector itself must be moved repeatedly along the bank of needles. In this case it is convenient to employ a battery-operated ultrasonic transmitter on the mobile detector which, on detecting a faulty needle, transmits a signal to an electric mains-operated receiver fixed on the machine that operates the machine stop motion.

FIG. 20 shows a suitable circuit for the transmitter. The mobile faulty needle detector 52 is connected to the junction point of an RC timer circuit 53 the resistor 54 of which has its other terminal connected to the positive pole of a dry cell battery while the other terminal of the capacitor 55 is grounded. The capacitor is normally charged but it discharges if a faulty needle is detected thereby setting oscillator circuit 56 into oscillation. As soon as the mobile detector travels beyond the faulty needle the capacitor 55 begins to charge again and stops the oscillator after a period determined by the time constant of the RC timer circuit 53, this period being typically three seconds, assuming a traverse of the knitting machine takes about one second. If desired, the resistor 54 may be a variable resistor for adjusting the time constant of the RC circuit. During the period of oscillation an ultrasonic transmitter 57 driven by the oscillator transmits a signal to be picked up by the stationary receiver when the transmitter passes it. Suitable ultrasonic transmitters and receivers are readily available that operate at, say, 40 kHz with a directional angle of 20° and a more than adequate range. Since the detector circuit draws a small current only during the period of discharge and recharge of the timer capacitor upon detection of a fault, the small dry cell battery will provide the necessary supply for a long time without replacement.

The resilient pressure of the detector on the needles should be low and a loading in the order of 3 grammes is envisaged. The mounting of the detector may make provision for easy adjustment of the detector and for ready replacement of one detector head with another. If desired, the amount of lateral shift of which the detector is capable may be variable according to requirements. Independent light pressure on the probe element of the detector may be provided to ensure good contact when a closed latch or damaged hook is encountered.

The detector must be designed so that, for the duty and speed of travel envisaged, it cannot miss faults by "jumping" gaps. In some machines, it may be convenient to mount a number of such detectors at intervals, rather than a single detector to monitor the whole needle bank.

The same principles can be extended to the monitoring of other beds or arrays of like items, or of surfaces, either straight or curved. Where a surface is of conductive metal, metal-to-metal contact of the probe on the surface can be employed to set up the desired signal; but if the surface is non-electrically conductive then other methods of signalling can be employed, e.g. movement of the probe can generate a signal.

We claim:

1. A detector device to monitor electrically-conductive surfaces; or beds or arrays of electrically-conductive items or components, for the detection of flaws, breakages, discontinuities and the like, comprising a carrier, a non-electrically conductive feeler element borne by said carrier which feeler element is normally resiliently urged laterally toward and into contact with the surface, bed or array to be monitored as the carrier and said surface, bed or array move relatively past one another, an electrically-conductive probe element mounted on said carrier for lateral movement toward the surface, bed or array in company with said feeler element which probe element is normally out of contact with said surface, bed or array; and electrical fault-sensing circuitry generating fault-indicating signals in response to every electrical contact occurring between said probe element and said surface, bed or array both when consequent upon lateral movement of said probe element in company with said feeler element and when no lateral movement of the probe element occurs.

2. A detector device according to claim 1, wherein the feeler element is a roller and the probe element lies beyond one end of the roller and extends in a direction transverse to the roller axis.

3. A detector device according to claim 1, wherein the feeler element is in the form of a plunger head on a stem and the probe element is formed by an arm alongside the plunger head which arm is part of a member that is slidably mounted on the plunger stem and spring-urged toward the plunger head.

4. A detector device according to claim 1, comprising a bent springy metal strip adapted for mounting on said carrier at one end and having an insulated length constituting the feeler element at or near its other end, the probe element being formed by an insulated projection at one edge of said insulated length.

5. A detector device according to claim 1, wherein said insulated length of the strip is bent so that the end portion of the strip is parallel to but offset with respect to the main portion.

6. A detector device according to claim 5, wherein the probe element is constituted by a triangular flange at one edge of said offset end portion of the strip.

7. A detector device according to claim 1, comprising a composite strip of springy metal adapted for mounting on said carrier at one end and having said feeler and probe elements at its opposite end, said composite strip comprising an electrically insulated strip member and an uninsulated electrically conductive strip member secured face to face, with a portion of the insulated strip providing the feeler element and a portion of the uninsulated strip member constituting the probe element.

8. A detector device according to claim 7, wherein the feeler element comprises a projecting lug on the electrically insulated strip and the probe element comprises a projecting flange on the uninsulated strip.

9. A detector device according to claim 1, wherein the feeler element is coated with antifriction material.

10. A detector device according to claim 1, wherein the edges of the feeler element are rounded, chamfered or bevelled so as to ride easily over the surface, bed or array to be monitored.

11. A detector device according to claim 1, wherein the feeler element and the probe element are independently spring-urged.

12. A detector device according to claim 1, to monitor a bed of latch-type needles in a knitting machine, wherein the feeler element contacts the upper portions of the needle hooks, and the probe element normally passes through the hook openings of the needles without contacting the needles so long as the needle latches are open.

13. A detector device according to claim 12, for a circular knitting machine with travelling needles, wherein the feeler and probe elements have an angular set or cut-off enabling the detector device to be mounted on the machine at a position where the needles are both travelling horizontally and being cammed vertically.

14. A detector device for a circular knitting machine, according to claim 12, in combination with a controller that responds to a fault signal from the detector device by operating a machine stop-motion, said controller bringing the needle giving rise to the fault signal to a particular predetermined position along the path of needle travel before the machine stops.

15. The combination according to claim 14, wherein the controller comprises counter circuits into which a first number is preset representing the number of needles between the position of the detector device and the predetermined position that a needle giving rise to a fault signal is to reach before the machine stops, and a needle sensor which delivers count pulses representing the passage past it of the individual needles to the counter circuits all the time the machine is running.

16. The combination according to claim 15, wherein the counter circuits of the controller are also preset with a second number selected to be less than the first member, and the controller operates the stop motion on a first occasion in response to a signal indicating that the number of needles that have passed the needle sensor since the occurrence of a fault signal has reached the smaller second preset number and again, on a second occasion, after the machine has been restarted, in response to a signal indicating that said number of needles has reached the first preset number.

17. The combination according to claim 16, wherein the selected difference between the first and second preset numbers is large enough to prevent machine overrun at the first stop causing the needle giving rise to the fault signal to reach its final predetermined stopping position, and small enough to prevent the machine gathering significant speed between the first and second stops.

18. The combination according to claim 16, wherein the controller displays a number which, when the second machine stop position is reached, represents the number of needles, if any, that the needle giving rise to the fault signal is displaced from the exact predetermined stopping position.

19. The combination according to claim 14, wherein the controller has a plurality of channels for connection of a plurality of respective detector devices, with signal lamps to indicate any channel in which a needle fault has been detected.

20. The combination according to claim 14, wherein the controller includes circuitry that enters a lock-out mode in which the machine stops and cannot be restarted until the controller has been reset and a warning lamp remains lit until all faults have been cleared, in response to signals indicating more than one needle fault.

21. A detector device according to claim 12, for a knitting machine in which the needles do not travel, said detector device being mounted on a mobile carrier to traverse to and fro along the bed of needles.

22. A detector device according to claim 21, wherein the mobile carrier carries a battery operated transmitter for transmitting fault signals from the detector device to a stationary receiver on the machine frame.

23. A detector device according to claim 22, wherein the transmitter is ultrasonic and includes an oscillator generating an output at ultrasonic frequency for a timed period after a fault signal appears, said period being greater than the time required for the mobile carrier to traverse the whole of the needle bed and thereby pass the stationary receiver.

24. A detector device according to claim 23, wherein the transmitter includes an RC timer circuit comprising a capacitor that is normally charged by the battery and is discharged when a needle fault is detected, the oscillator being triggered into oscillation when the capacitor is discharged and stopping oscillation when the capacitor is recharged to a certain level.

25. A detector device to monitor a bed of latch-type needles in a knitting machine, comprising a carrier for mounting on the machine in a position where the needles move relatively past the carrier, a feeler element mounted on the carrier which feeler element is resiliently urged laterally toward and into contact with the upper portions of the needle hooks as the needles move past, a probe element mounted on the carrier for lateral movement toward the needles in company with said feeler element which probe element normally passes through the hook openings of the needles without contacting the needles so long as the needle latches are open, electrical fault-sensing circuitry generating fault-indicating signals in response to every contact occurring between said probe element and a needle, and a controller that responds to a fault-indicating a signal from said fault-sensing circuitry by operating a machine stop-motion to bring the machine to a stop when the needle giving rise to the fault-indicating signal reaches a predetermined position.

26. A detector device to monitor a plurality of aligned surfaces or beds or arrays of items or components for the detection of flaws, breakage, discontinuities and the like comprising a carrier, means for resiliently urging said carrier into contact with a surface, defined by the items to be monitored, means for producing movement between said carrier and the items along a path parallel to the plane of the surface defined by the items, a probe, means coupling said probe to said carrier to urge said probe toward the surface defined by the items, said means maintaining said probe spaced from the surface defined by the items, at a location to be contacted by a misplaced element of the items, said carrier urging said probe into contact with an item upon detecting an abnormality in the physical structure of the item and means for indicating contact between said probe and the item.

* * * * *